US008869674B2

(12) United States Patent
Ruck et al.

(10) Patent No.: US 8,869,674 B2
(45) Date of Patent: Oct. 28, 2014

(54) GAS PISTON CONTROL SYSTEM FOR A FIREARM

(71) Applicants: Michael Alan Ruck, Diamond Springs, CA (US); Robert Anderson, Placerville, CA (US); Erik Christopher Anderson, Placerville, CA (US); Michael Arthur Ruck, Diamond Springs, CA (US)

(72) Inventors: Michael Alan Ruck, Diamond Springs, CA (US); Robert Anderson, Placerville, CA (US); Erik Christopher Anderson, Placerville, CA (US); Michael Arthur Ruck, Diamond Springs, CA (US)

( * ) Notice: Subject to any disclaimer, the term of this patent is extended or adjusted under 35 U.S.C. 154(b) by 80 days.

(21) Appl. No.: 13/683,273

(22) Filed: Nov. 21, 2012

(65) Prior Publication Data

US 2014/0060312 A1 Mar. 6, 2014

Related U.S. Application Data

(60) Provisional application No. 61/633,639, filed on Feb. 14, 2012.

(51) Int. Cl.
*F41A 5/28* (2006.01)

(52) U.S. Cl.
CPC ..... *F41A 5/28* (2013.01)
USPC ..... 89/193

(58) Field of Classification Search
USPC ..... 89/191.01–193
See application file for complete search history.

(56) References Cited

U.S. PATENT DOCUMENTS

| | | | | |
|---|---|---|---|---|
| 454,403 | A | 6/1891 | Odkolek | |
| 698,107 | A | 4/1902 | De Knight | |
| 709,880 | A | 9/1902 | De Knight | |
| 709,881 | A | 9/1902 | De Knight | |
| 709,882 | A | 9/1902 | De Knight | |
| 709,883 | A | 9/1902 | De Knight | |
| 1,195,693 | A | 8/1916 | Lewis | |
| 1,366,863 | A | 1/1921 | Berthier | |
| 1,388,879 | A | 8/1921 | Nelson | |
| 1,431,059 | A | 10/1922 | Sutter | |
| 1,811,693 | A | 6/1931 | Larsson | |
| 2,144,241 | A | 1/1939 | Eiane | |
| 2,149,512 | A | 3/1939 | Eiane | |
| 2,560,292 | A | 7/1951 | Kauch | |
| 2,791,944 | A | 5/1957 | Harvey | |
| 2,845,008 | A | 7/1958 | Atwood | |
| 2,918,848 | A * | 12/1959 | Maillard | 89/193 |
| 3,036,501 | A | 5/1962 | Wild | |
| 3,333,509 | A | 8/1967 | Muhlemann | |
| 3,982,468 | A * | 9/1976 | Browning | 89/193 |

(Continued)

FOREIGN PATENT DOCUMENTS

GB 1567317 5/1980

*Primary Examiner* — Michael David
(74) *Attorney, Agent, or Firm* — Karish & Bjorgum PC; Marc Karish

(57) ABSTRACT

A gas system for a firearm having a gas block coupled to a barrel with a gas capture port in communication with a barrel gas port. A sleeve removeably mounted inside the gas block has: a gas conduit; a seat near the gas conduit; a projection; and a rod conduit communicating gas through the projection. A rod movably mounted in the gas block has a cup fitting over the projection.

A valve has a knob coupleable to the gas block and a plug moveable within the pressure sleeve with a plunger engageable with the seat to adjust gas flow through the gas conduit to the rod conduit. Gas discharged from a fired cartridge flows against the cup to drive the rod to reload the firearm. The plug is moveable by the knob to a plurality of positions to alter the gas conveyed to the rod.

16 Claims, 5 Drawing Sheets

(56) References Cited

U.S. PATENT DOCUMENTS

| | | | | | |
|---|---|---|---|---|---|
| 3,988,964 | A | | 11/1976 | Moore | |
| 3,990,348 | A | * | 11/1976 | Vesamaa | 89/193 |
| 4,102,243 | A | | 7/1978 | Jennie | |
| 4,125,054 | A | | 11/1978 | Jennie | |
| 4,599,934 | A | * | 7/1986 | Palmer | 89/193 |
| 4,702,146 | A | * | 10/1987 | Ikeda et al. | 89/193 |
| 5,272,956 | A | | 12/1993 | Hudson | |
| 5,429,034 | A | * | 7/1995 | Badali et al. | 89/193 |
| 5,768,818 | A | | 6/1998 | Rustick | |
| 5,886,281 | A | | 3/1999 | Kirstein | |
| 5,959,234 | A | * | 9/1999 | Scaramucci et al. | 89/193 |
| 6,382,073 | B1 | * | 5/2002 | Beretta | 89/193 |
| 7,461,581 | B2 | | 12/2008 | Leitner-Wise | |
| 7,469,624 | B1 | | 12/2008 | Adams | |
| 7,610,844 | B2 | | 11/2009 | Kuczynko | |
| 7,621,210 | B2 | | 11/2009 | Fluhr | |
| 7,637,199 | B2 | * | 12/2009 | Fluhr et al. | 89/193 |
| 7,739,939 | B2 | | 6/2010 | Adams | |
| 7,779,743 | B2 | | 8/2010 | Herring | |
| 7,810,423 | B2 | * | 10/2010 | Monroe | 89/193 |
| 7,856,917 | B2 | | 12/2010 | Noveske | |
| 7,971,518 | B2 | | 7/2011 | Adams | |
| 8,065,949 | B1 | | 11/2011 | Molinari | |
| 8,176,837 | B1 | * | 5/2012 | Jackson | 89/193 |
| 8,286,542 | B2 | | 10/2012 | Griffin | |
| 8,528,458 | B2 | * | 9/2013 | Windauer | 89/193 |
| 8,701,543 | B2 | * | 4/2014 | Brinkmeyer et al. | 89/193 |
| 2009/0229454 | A1 | | 9/2009 | Fluhr | |
| 2012/0017755 | A1 | | 1/2012 | Molinari | |

* cited by examiner

GAS PISTON CONTROL SYSTEM FOR A FIREARM

CROSS-REFERENCE TO RELATED APPLICATION(S)

This application claims priority of U.S. Provisional Patent Application No. 61/633,639 filed on Feb. 14, 2012, entitled RIFLE LOWER AND UPPER RECEIVER AND MONOLITHIC HANDGUARD RAIL SYSTEM AND GAS PISTON SYSTEM AND IMPROVEMENTS, the entire contents of which are hereby incorporated herein by reference.

BACKGROUND OF THE INVENTION

The present invention relates to firearms and, more particularly, to gas recoil automatic and semiautomatic firearms and to improvements in the gas systems thereof.

In firearms of the gas operated type in which propellant gases are tapped from the barrel and employed to drive a piston which actuates the gun action, it is often desirable to have some means of regulating the energy transmitted to the piston. This is especially desirable in firearms that are adapted to fire a variety of types of ammunition, each developing widely varying pressure characteristics in the barrel.

If no control device is provided to compensate for the varying pressure, the gun must be designed to function with that round of ammunition which develops the least gas pressure energy on the operating piston. However, when firing rounds that develop high pressure levels, excessive energy is transmitted to the action which tends to increase wear and tear and shorten the life of the firearm. Current methods of compensating for the varying pressure suffer from one or more of the following deficiencies: inability to adjust for a wide range of ammunition, inability to quickly disassemble and clean the mechanism such as might be necessary in the field, require the release of light, heat and sound which may render the weapon unsuitable for certain uses and inefficiencies render the method unsuitable for use with certain types of ammunition, such as subsonic rounds.

Accordingly, an improved system and method of controlling gas pressure in a piston actuated auto-loading firearm is needed.

SUMMARY OF THE INVENTION

An object of the present invention is to integrate an improved gas piston operating system into a firearm that increases accuracy of the firearm while retaining an elegant and simple method of operation. Another object of the present invention is to provide an improved gas piston operating system that is simple to train users to operate. Another object of the present invention is to provide an improved gas piston operating system that extends the life expectancy of high-wear components. Another object of the present invention is to provide an improved gas piston operating system that has the ability to compensate for various ammunition types and for the use of various suppressors.

In an embodiment, the present invention is directed to a gas system for a firearm having a barrel with a bore and a gas port in communication with the bore. The gas system has a gas block coupled to the barrel, the gas block having a gas capture port in communication with the barrel gas port. A pressure sleeve is removeably mounted inside the gas block, the pressure sleeve having a gas conduit in communication with the gas capture port; a seat proximal to the gas conduit; a projection; and a rod conduit for communicating gas through the projection. An operating rod is movably mounted in the gas block, the operating rod having a cup configured to fit over the projection.

A valve is mountable to the gas block, the valve having a knob coupleable to the gas block; and a plug moveably mountable within the pressure sleeve, the plug having a plunger engageable with the seat to adjust gas flow through the gas conduit to the rod conduit. A spring is mounted around the rod for biasing the rod toward the gas block. Gas discharged from a fired cartridge flows through the gas port, the gas capture port, the gas conduit and the rod conduit and against the rod cup to drive the rod to reload the firearm. The plug is moveable by the knob to a plurality of positions to alter the gas conveyed to the operating rod.

The operating rod may have a flange proximal to the cup and gas discharged from a fired cartridge may also flow against the flange to drive the rod to reload the firearm. The operating rod may also have at least one gas trap proximal to the flange and gas discharged from a fired cartridge may also flow into the gas trap to drive the rod to reload the firearm. The operating rod may have a plurality of gas traps.

In an embodiment, the gas block has a sleeve for holding an end of the operating rod. The seat and the plunger may be substantially conical. The projection may be substantially cylindrical. In an embodiment, the gas system has a teardown pin, the pressure sleeve has a detent and the teardown pin is mountable in the detent to hold the pressure sleeve in the gas block. In an embodiment, the knob has a plurality of circumferential teeth and the gas block has a spring engageable with the teeth to maintain the position of the knob. Optionally, the knob is moveable to at least 20 different positions. In an embodiment, the plug further comprises at least one groove. The gas system may also have a barrel nut for coupling the barrel to a remainder of the firearm; and a heat sink coupled to the barrel nut, the heat sink having a rod guide.

The present invention according to another embodiment is directed to a gas system for a firearm having a barrel with a bore and a gas port in communication with the bore, the gas system having a gas block coupled to the barrel, the gas block having a gas capture port in communication with the barrel gas port. A pressure sleeve is mountable inside the gas block, the pressure sleeve having: a gas conduit in communication with the gas capture port and a seat proximal to the gas conduit. An operating rod is movably mounted in the gas block over a portion of the pressure sleeve, the operating rod having a cup configured to receive gas from the gas conduit. A needle valve is mountable to the gas block, the valve having a plunger engageable with the seat to adjust gas flow through the gas conduit. Gas discharged from a fired cartridge flows through the gas port, the gas capture port and the gas conduit and against the cup to drive the operating rod to reload the firearm.

The operating rod may also have a flange proximal to the cup and at least one gas trap proximal to the flange; and gas discharged from a fired cartridge may also flow against the flange and into the gas trap to drive the rod to reload the firearm. The seat and the plunger may be substantially conical. The gas system may also have a teardown pin and the pressure sleeve may have a detent; the teardown pin is mountable in the detent to hold the pressure sleeve in the gas block.

The present invention is also directed to a firearm having a barrel with a bore and a gas port in communication with the bore. The firearm also has a gas system having a gas block coupled to the barrel, the gas block having a gas capture port in communication with the barrel gas port. A pressure sleeve is removeably mounted inside the gas block, the pressure sleeve having: a gas conduit in communication with the gas capture port; a seat proximal to the gas conduit; a projection; and a rod conduit for communicating gas through the projection. An operating rod is movably mounted in the gas block, the operating rod having a cup configured to fit over the projection; a flange proximal to the cup; and at least one gas trap proximal to the flange.

A valve is mountable to the gas block, the valve having a knob mountable to the gas block; and a plug moveably mountable within the pressure sleeve, the plug having a plunger engageable with the seat to adjust gas flow through the gas conduit to the rod conduit. The firearm also has a means for biasing the rod toward the gas block. Gas discharged from a fired cartridge flows through the gas port, the gas capture port, the gas conduit and the rod conduit and against the rod cup, flange and trap to drive the rod to reload the firearm. The plug is moveable by the knob to a plurality of positions to alter the gas conveyed to the operating rod. In an embodiment, the seat and the plunger are substantially conical. In an embodiment, the gas block also has a means for maintaining position of the knob. In an embodiment, the firearm also has a barrel nut for coupling the barrel to the firearm and a heat sink coupled to the barrel nut, the heat sink having a rod guide.

BRIEF DESCRIPTION OF THE DRAWINGS

The features, aspects and advantages of the present invention will become better understood with regard to the following description, appended claims and accompanying figures wherein:

DETAILED DESCRIPTION OF THE INVENTION

Figure 1:
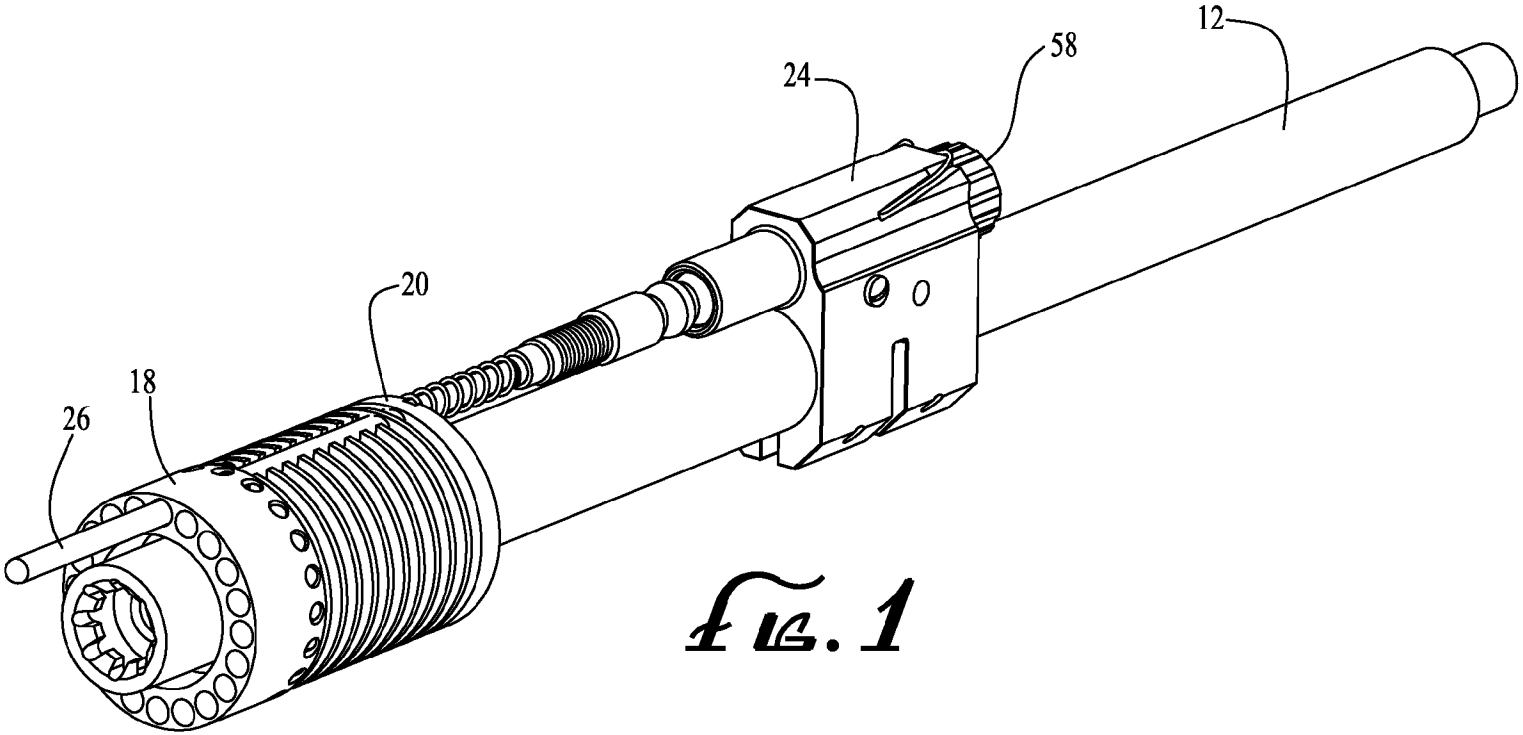
FIG. 1 is a perspective elevation view of a gas system of a firearm according to an embodiment of the present invention mounted to a barrel.

In the following description of the preferred embodiments, reference is made to the accompanying drawings which show by way of illustration specific embodiments in which the invention may be practiced. Wherever possible, the same reference numbers will be used throughout the drawings to refer to the same or like parts. It is to be understood that other embodiments may be utilized and structural and functional changes may be made without departing from the scope of the present invention.

FIGS. 1 to 6 show a gas piston control system 10 for a firearm according to an embodiment of the present invention. The firearm has a cylindrical barrel 12 having a bore 14. The barrel 12 is mounted to an upper receiver of the firearm using a barrel nut 18. A heat sink 20 is mounted on the barrel nut 18 at a proximal end of the barrel 12. A chamber in the upper receiver adjacent the proximal end of the barrel 12 is configured to receive a cartridge provided with a projectile. When the cartridge is fired, the projectile exits the barrel 12 at a distal end.

The barrel 12 has a gas port 22 for communicating gas from the bore 14. A gas block 24 is mounted to the barrel 12 proximate to the gas port 22. An operating rod 26 is moveably mounted between the heat sink 20 and the gas block 24.

The gas block 24 has a clamp 28 that fits around the barrel 12. The clamp 28 has a plurality of mounting holes 30. At least one mounting bolt 32 fits through the mounting holes 30 to tighten the clamp 28 and affix the gas block 24 to the barrel 12. In an embodiment, there are four mounting holes 30 and two mounting bolts 32. In an embodiment, the mounting bolts 32 are quickly removable to allow for disassembly of the gas block 24 from the barrel 12, such as for cleaning.

As will be understood by those of skill in the art, other means for fastening the gas block onto the barrel may be used. For example, the barrel may have at least one mounting channel and the clamp may have mounting pins that pass through the mounting holes 30 and through the barrel mounting channel to affix the gas block 24 to the barrel 12. Additionally, the barrel may have a transverse channel (not shown), the gas block may have a barrel alignment hole 31. A pin 33 may be mountable through the barrel alignment hole 31 and the transverse channel on the barrel to ensure that the gas block is properly positioned on the barrel for mounting by the clamp.

The components of the gas block 24 will now be considered in more detail with reference to FIGS. 2 to 6. The gas block 24 has a gas capture port 34 which is aligned with the barrel gas port 22 when the gas block 24 is mounted to the barrel 12. The gas capture port 34 allows for gas from the bore 14 to be communicated inside the gas block 24. The gas block 24 has an operating rod sleeve 36 for holding an end of the operating rod 26.

A pressure sleeve 38 is removably positioned in the gas block 24. The pressure sleeve 38 has a gas conduit 40 that aligns with the gas capture port 34 for communication of gas from the barrel 12. The pressure sleeve also has a rod conduit 42 that passes through a substantially cylindrically shaped projection 43 for communication of gas to the operating rod 26. Between the gas conduit 40 and the rod conduit 42 is a seat 44. In an embodiment, the seat 44 is substantially conical.

The pressure sleeve 38 has a lock detent 46 for engagement with a teardown lock 48 on the gas block 24. In an embodiment, the teardown lock 48 has a spring 50 and a pin 52. The spring 50 holds the pin 52 in the detent 46 until the pin 52 is manually disengaged from the detent 46 to allow for removal of the pressure sleeve 38 such as for cleaning. Additionally, the pressure sleeve has an alignment tab 54 engageable with an alignment detent 56 in the gas block 24 to allow a user to easily align the pressure sleeve 38 within the gas block 24.

The gas piston control system also has an adjustable valve 58. The valve 58 has a knob 60 coupled to a plug 62. The knob 60 threads onto the gas block 24 to adjustably position the valve plug 62 within the pressure sleeve 38. By turning the valve knob 60, the valve plug 62 is infinitely adjustable between a position completely blocking the pressure sleeve gas conduit 40 and a position completely opening the pressure sleeve gas conduit 40.

Figure 6:
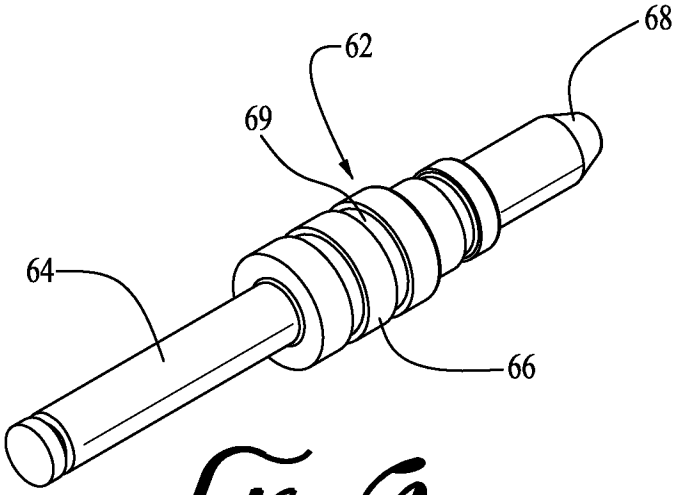
FIG. 6 is a perspective elevation view of a valve plug usable in the gas system of FIG. 1.

With reference to FIG. 6, the valve plug 62 has a shank 64 proximal to the adjuster valve knob 60, a body 66 and a plunger 68. The plunger 68 is configured to correspond to the seat 44 such that the plunger 68 may form a substantially leak free seal with the seat 44. In an embodiment, the plunger 68 is substantially conically shaped. In an embodiment, the body 66 further comprises at least one groove 69 to create a seal reducing the amount of gas that can escape around the plug 62.

In an embodiment, an outer circumference of knob 60 has a plurality of teeth 70. A spring 72 is coupled to the gas block 24 and engages the teeth 70 to limit unintentional rotation of the knob 60 and hold the valve plug 62 in a given position. The knob 60 contains a plug hole 74 through which the shank 64 is fitted. The knob 60 is coupled to the shank 64 using a fastener 76 such as a pin or c-clip. The number of teeth and the threads may be used to control how many different positions the valve plug may have between a fully open and a fully closed position. Preferably, the knob may be moved to at least 10 different positions, even more preferably to at least 20 different positions and even more preferably to at least 40 positions to allow for precise control over highly variable ammunition and suppressors.

Figure 2:
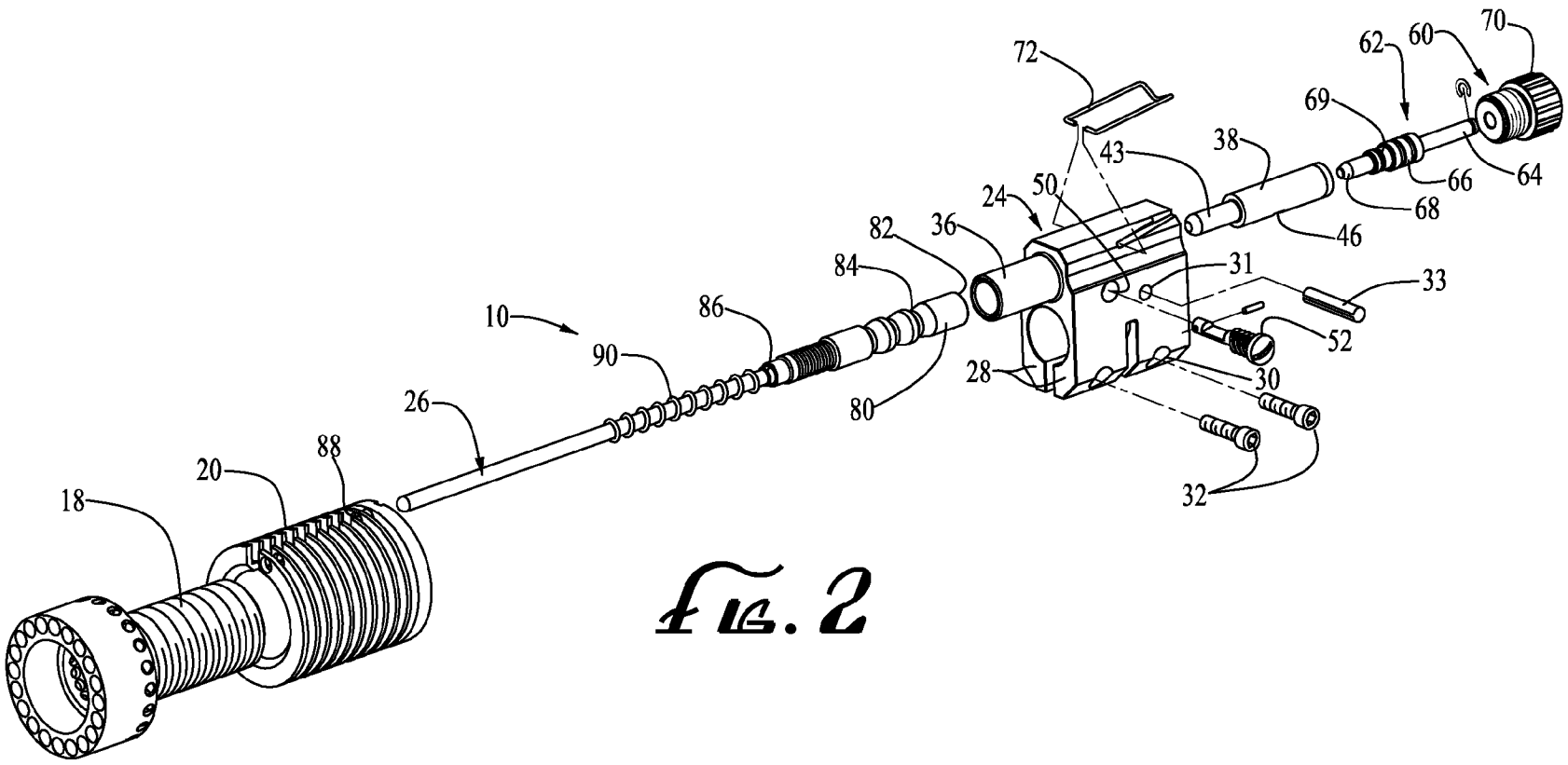
FIG. 2 is an exploded view of the gas system of FIG. 1.
Figure 3:
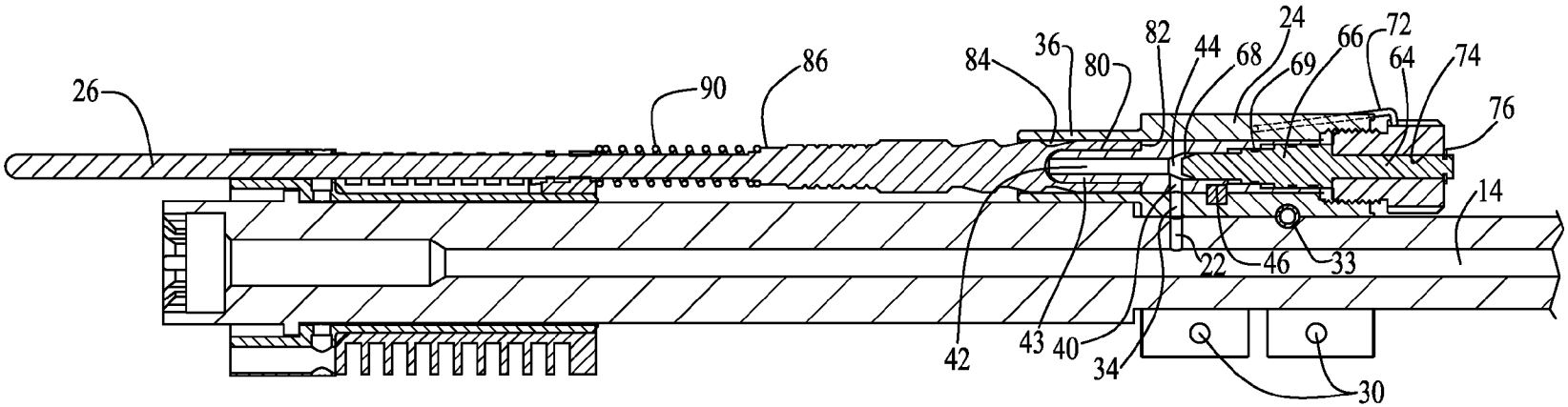
FIG. 3 is a side elevation cross sectional view of the gas system of FIG. 1.
Figure 4B:
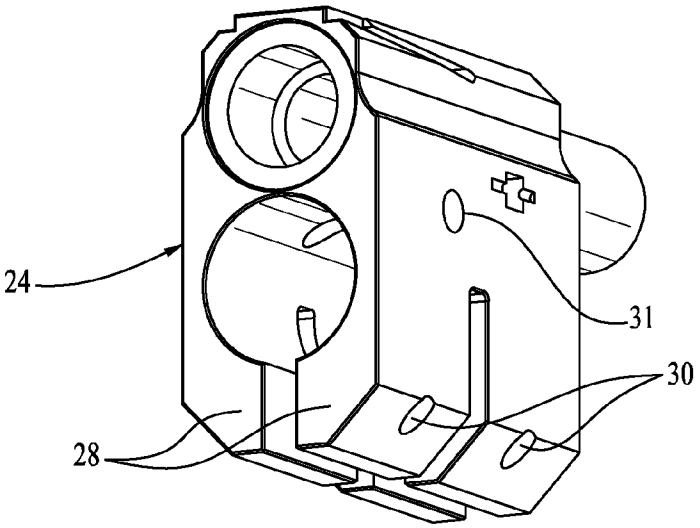
FIGS. 4A and 4B are perspective elevation views of a gas block usable in the gas system of FIG. 1.
Figure 4A:
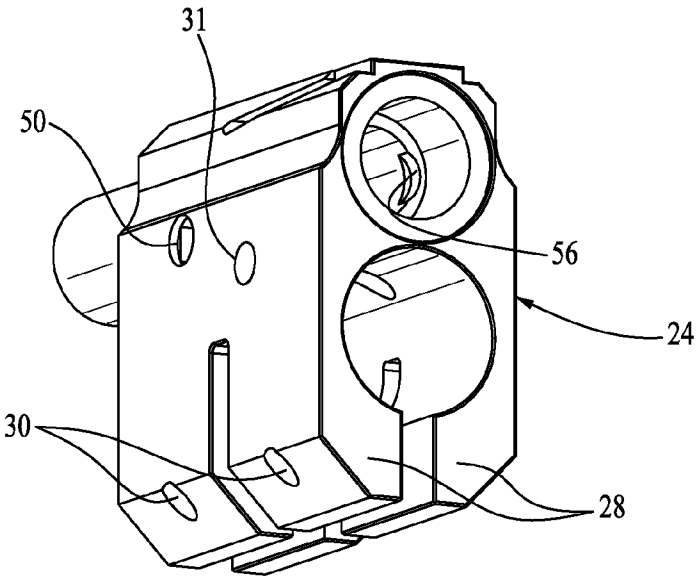
Figure 5:
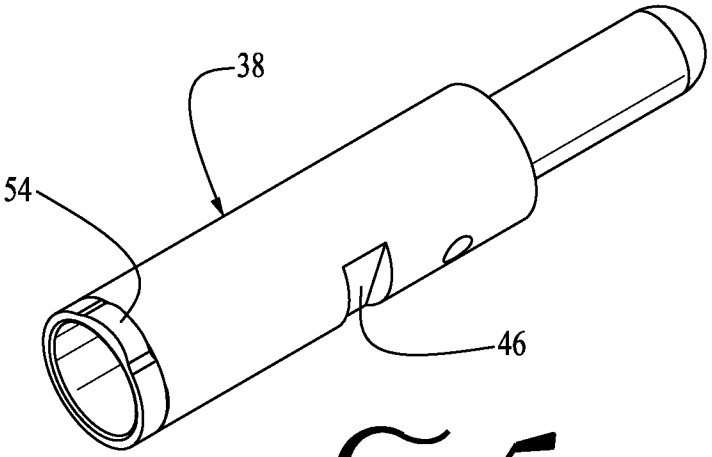
FIG. 5 is a perspective elevation view of a pressure sleeve usable in the gas system of FIG. 1.

The operating rod 26 will now be considered in more detail with reference to FIGS. 2 and 3. A first end of the operating rod 26 is positioned in the operating rod sleeve 36 of the gas block 24. Proximal to the first end of the operating rod 26 is a cup 80 for receiving gas. The cup 80 fits over the projection 43 of the pressure sleeve 38. The operating rod also has a flange 82 and at least one gas trap 84. The cup 80, flange 82 and gas trap 84 allows for a very efficient three stage system for activating the operating rod 26 using gas from the bore 14. Gas is initially fired into the cup 80. Gas is then incident on flange 82 while the operating rod 26 is fitted in pressure sleeve 38. Finally, pressure from gas leaving the pressure sleeve 38 is picked up the at least one gas trap 84. The operating rod 26 also has a flange 86 for mounting a spring as discussed below.

A second end of the operating rod 26 is positioned in an operating rod guide 88 on the heat sink 20. The operating rod guide 88 helps keep the operating rod 26 properly aligned. A spring 90 is mounted between the heat sink 20 and the flange 86. The spring 90 provides force on the operating rod 26 to maintain a secure fit against the pressure sleeve 38. The operating rod 26 is actuated by the force of expanding gas following the projectile through the barrel 12. The gas travels through the barrel gas port 22, the gas block gas capture port 34 and the pressure sleeve gas conduit 40 and the pressure sleeve rod conduit 42. The gas then acts on the cup 80, flange 82 and gas trap 84 of the operating rod 26 to turn pneumatic force into mechanical force and push the operating rod toward the upper receiver. The operating rod 26 drives a carrier in the upper receiver to cause a spent cartridge to be ejected and a new cartridge to be chambered. After the operating rod 26 strikes the carrier, the spring 90 forces the operating rod 26 back against the pressure sleeve 38.

The barrel nut 18 and heat sink 20 attach the barrel to the upper receiver of the rifle system, are a rigid attachment point for a hand guard and align the operating rod 26 through the upper receiver. Preferably, the barrel nut 18 and heat sink 20 are made from a highly conductive material to transfer heat from the barrel 12 into the hand guard to allow for faster cooling of the barrel 12. In an embodiment, at least one of the barrel nut 20 and the heat sink 20 are made of aluminum.

The system of the present invention provides increased consistency because the time the driving gas is in the system is reduced, which limits the time and area in which the gas can condense. This makes use of the pneumatic gas energy faster, thereby allowing for a shorter cycle time. Additionally, a substantially conically shaped seat 44 and plug 62 allows a large surface to be exposed to the hot gases which reduces the wear on the seat 44 and the plug 62. Gas pressure is regulated by rotating the knob 60 to move the plug 62 and the plunger 68 in relation to the seat 44 to progressively open or close the pressure sleeve gas conduit 40. This allows for adjustment of gas pressure to control carrier speed for different types of ammunition, as well as for suppressed fire or different rates of automatic fire.

The gas system according to embodiments of the present invention is intended to be used with firearms having a barrel with a bore and a gas port communicating gas from the bore, such as for example an AR-15 or M16 rifle. Preferably, the upper receiver is designed with a heavier mass than typical upper receivers to compensate for the increased force and torque involved with the gas piston system. The extra mass also allows for more consistent thermal behaviors, including the ability to absorb more heat out of the gas piston system.

The system of the present invention is designed to direct gas directly from the barrel onto the rod. This system is much more efficient than systems that require a chamber in a gas block to become pressurized and allows for the use of more varied ammunition. A firearm utilizing the gas system of the present invention may be used in a fully automatic mode with subsonic ammunition and with noise suppression, such as for use in tactical situations where noise suppression is critical.

The pressure sleeve 38 and operating rod 26 may be easily removed for cleaning, modification or replacement. The valve plug 62 may be removed from the gas block 24 by unscrewing the knob 60 until the knob threads disengage from threads on the gas block. The valve plug 62 may then be pulled out of the pressure sleeve 38 and the gas block 24. Once the valve plug 62 has been removed, the pressure sleeve 38 may be removed by manually disengaging the pin 52 from the detent 46 in the pressure sleeve. Once the pressure sleeve 38 has been removed the operating rod 26 may be removed by sliding the operating rod out through the gas block 24. This entire operation may be done very quickly and without tools, such as by a soldier in the field.

There is disclosed in the above description and the drawings, a gas system for a firearm which fully and effectively overcomes the disadvantages associated with the prior art. However, it will be apparent that variations and modifications of the disclosed embodiments may be made without departing from the principles of the invention. The presentation of the preferred embodiments herein is offered by way of example only and not limitation, with a true scope and spirit of the invention being indicated by the following claims.

Any element in a claim that does not explicitly state "means" for performing a specified function or "step" for performing a specified function, should not be interpreted as a "means" or "step" clause as specified in 35 U.S.C. §112.

What is claimed is:

1. A gas system for a firearm having a barrel with a bore and a gas port in communication with the bore, the gas system comprising:

a gas block coupled to the barrel, the gas block comprising:
- a gas capture port in communication with the barrel gas port;

a pressure sleeve removeably mounted inside the gas block, the pressure sleeve comprising:
- a gas conduit in communication with the gas capture port;
- a seat proximal to the gas conduit;
- a projection; and
- a rod conduit for communicating gas through the projection;

an operating rod movably mounted in the gas block, the operating rod comprising a cup configured to fit over the projection;

a valve mountable to the gas block, the valve comprising:
- a knob coupleable to the gas block; and
- a plug moveably mountable within the pressure sleeve, the plug having a plunger engageable with the seat to adjust gas flow through the gas conduit to the rod conduit; and a spring mounted around the rod for biasing the rod toward the gas block;

wherein gas discharged from a fired cartridge flows through the gas port, the gas capture port, the gas conduit and the rod conduit and against the rod cup to drive the rod to reload the firearm; and the plug is moveable by the knob to a plurality of positions to alter the gas conveyed to the operating rod.

2. The gas system of claim 1 wherein the operating rod further comprises a flange proximal to the cup and wherein gas discharged from a fired cartridge further flows against the flange to drive the rod to reload the firearm.

3. The gas system of claim 2 wherein the operating rod further comprises at least one gas trap proximal to the flange and wherein gas discharged from a fired cartridge further flows into the gas trap to drive the rod to reload the firearm.

4. The gas system of claim 3 wherein the operating rod further comprises a plurality of gas traps.

5. The gas system of claim 1 wherein the gas block further comprises a sleeve for holding an end of the operating rod.

6. The gas system of claim 1 wherein the seat and the plunger are substantially conical.

7. The gas system of claim 1 wherein the projection is substantially cylindrical.

8. The gas system of claim 1 further comprising a teardown pin; and wherein the pressure sleeve further comprises a detent; and the teardown pin is mountable in the detent to hold the pressure sleeve in the gas block.

9. The gas system of claim 1 wherein the knob has a plurality of circumferential teeth and the gas block has a spring engageable with the teeth to maintain the position of the knob.

10. The gas system of claim 1 wherein the knob is moveable to at least 20 different positions.

11. The gas system of claim 1 wherein the plug further comprises at least one groove.

12. The gas system of claim 1 further comprising:

a barrel nut for coupling the barrel to a remainder of the firearm; and a heat sink coupled to the barrel nut, the heat sink having a rod guide.

13. A firearm comprising:

a barrel comprising a bore and a gas port in communication with the bore a gas system comprising:

a gas block coupled to the barrel, the gas block comprising:

a gas capture port in communication with the barrel gas port;

a pressure sleeve removeably mounted inside the gas block, the pressure sleeve comprising:

a gas conduit in communication with the gas capture port;

a seat proximal to the gas conduit;

a projection; and a rod conduit for communicating gas through the projection;

an operating rod movably mounted in the gas block, the operating rod comprising:

a cup configured to fit over the projection;

a flange proximal to the cup; and at least one gas trap proximal to the flange;

a valve mountable to the gas block, the valve comprising:

a knob mountable to the gas block; and a plug moveably mountable within the pressure sleeve, the plug having a plunger engageable with the seat to adjust gas flow through the gas conduit to the rod conduit; and a means for biasing the rod toward the gas block;

wherein gas discharged from a fired cartridge flows through the gas port, the gas capture port, the gas conduit and the rod conduit and against the rod cup, flange and trap to drive the rod to reload the firearm; and the plug is moveable by the knob to a plurality of positions to alter the gas conveyed to the operating rod.

14. The gas system of claim 13 wherein the seat and the plunger are substantially conical.

15. The gas system of claim 14 further comprising a means for maintaining position of the knob.

16. The gas system of claim 15 further comprising:

a barrel nut for coupling the barrel to the firearm;

a heat sink coupled to the barrel nut, the heat sink having a rod guide.

* * * * *